US008851478B2

(12) United States Patent
Moody

(10) Patent No.: US 8,851,478 B2
(45) Date of Patent: Oct. 7, 2014

(54) VIDEO POKER GAMES

(75) Inventor: Ernest W. Moody, Las Vegas, NV (US)

(73) Assignee: Ernest Moody Revocable Trust, Las Vegas, NV (US)

( * ) Notice: Subject to any disclaimer, the term of this patent is extended or adjusted under 35 U.S.C. 154(b) by 921 days.

(21) Appl. No.: 12/497,680

(22) Filed: Jul. 5, 2009

(65) Prior Publication Data

US 2009/0270153 A1 Oct. 29, 2009

Related U.S. Application Data

(60) Division of application No. 11/067,386, filed on Feb. 26, 2005, now Pat. No. 7,581,730, and a continuation-in-part of application No. 10/347,949, filed on Jan. 21, 2003, now abandoned.

(60) Provisional application No. 60/351,455, filed on Jan. 22, 2002.

(51) Int. Cl.
*A63F 1/00* (2006.01)
*G07F 17/32* (2006.01)
*A63F 3/00* (2006.01)

(52) U.S. Cl.
CPC ..... *G07F 17/32* (2013.01); *A63F 2001/005* (2013.01); *G07F 17/3262* (2013.01); *A63F 2001/008* (2013.01); *G07F 17/3293* (2013.01); *A63F 3/00157* (2013.01)
USPC ..... 273/292

(58) Field of Classification Search
USPC ..... 273/292
See application file for complete search history.

(56) References Cited

U.S. PATENT DOCUMENTS

| | | | | |
|---|---|---|---|---|
| 5,823,873 | A * | 10/1998 | Moody | 463/13 |
| 6,098,985 | A | 8/2000 | Moody | |
| 6,132,311 | A * | 10/2000 | Williams | 463/13 |
| 6,135,883 | A * | 10/2000 | Hachquet | 463/13 |
| 6,146,271 | A * | 11/2000 | Kadlic | 463/13 |
| 6,371,851 | B1 * | 4/2002 | Singer et al. | 463/13 |
| 6,443,456 | B1 * | 9/2002 | Gajor | 273/303 |
| 6,669,198 | B2 | 12/2003 | Wichinsky | |
| 6,672,959 | B2 * | 1/2004 | Moody et al. | 463/13 |
| 6,708,975 | B1 | 3/2004 | Fox et al. | |
| 6,729,621 | B2 | 5/2004 | Moody | |
| 6,857,957 | B2 | 2/2005 | Marks et al. | |
| 6,878,060 | B2 | 4/2005 | Moody | |
| 6,955,356 | B2 | 10/2005 | Moody | |
| 6,964,418 | B2 * | 11/2005 | Moody | 273/292 |
| 7,059,604 | B1 | 6/2006 | Richards et al. | |
| 7,137,628 | B2 | 11/2006 | Moody | |
| 7,156,397 | B2 | 1/2007 | Moody et al. | |
| 7,247,091 | B2 | 7/2007 | Moody | |
| 7,581,730 | B2 * | 9/2009 | Moody | 273/292 |

(Continued)

*Primary Examiner* — Kurt Fernstrom
*Assistant Examiner* — Dolores Collins
(74) *Attorney, Agent, or Firm* — John Edward Roethel

(57) ABSTRACT

One or more additional "bonus hand" cards that have no playing value are added to the deck of playing cards that is used in a video poker. When a "bonus hand" card appears in the player's initially dealt hand of cards, the player receives a second bonus hand of the initially dealt hand of cards. Alternatively, if the bonus hand card appears as one of the replacement cards during the draw step of video poker, the player is provided with another poker hand. In general, any type of triggering event is provided which awards the player another hand of video poker for no additional charge if the triggering event occurs during the player of the video poker hand.

3 Claims, 4 Drawing Sheets

(56) References Cited

U.S. PATENT DOCUMENTS

| | | | |
|---|---|---|---|
| 2002/0142828 | A1 | 10/2002 | Moody |
| 2002/0145255 | A1 | 10/2002 | Rudolph |
| 2002/0198040 | A1 | 12/2002 | Moody |
| 2003/0032469 | A1 | 2/2003 | Moody et al. |
| 2003/0040352 | A1 | 2/2003 | Marks et al. |
| 2003/0164590 | A1 | 9/2003 | Moody |
| 2003/0166411 | A1 | 9/2003 | Moody |
| 2003/0189290 | A1 | 10/2003 | Moody |
| 2003/0214097 | A1 | 11/2003 | Moody |
| 2004/0017043 | A1 | 1/2004 | Moody |
| 2004/0043807 | A1 | 3/2004 | Pennington |
| 2004/0116171 | A1 | 6/2004 | Moody |
| 2004/0188938 | A1 | 9/2004 | Moody et al. |
| 2005/0230917 | A1 | 10/2005 | Jackson |
| 2006/0009272 | A1 | 1/2006 | Moody |
| 2006/0052157 | A1 | 3/2006 | Walker et al. |
| 2006/0105828 | A1 | 5/2006 | FitzGerald et al. |
| 2006/0246981 | A1 | 11/2006 | Walker et al. |
| 2006/0267283 | A1 | 11/2006 | Jackson |
| 2006/0267284 | A1 | 11/2006 | Jackson |
| 2007/0054721 | A1 | 3/2007 | Jackson |

* cited by examiner

VIDEO POKER GAMES

CROSS-REFERENCE TO RELATED APPLICATION

This application is a Divisional of application Ser. No. 11/067,386, filed Feb. 26, 2005, entitled "Video Poker Games", now pending, which is a Continuation-in-Part of application Ser. No. 10/347,949, filed Jan. 21, 2003, entitled "Video Poker Games", now abandoned and is also based on and claims priority of Provisional Application Ser. No. 60/351,455, filed Jan. 22, 2002, entitled "Video Poker Games.".

This invention relates primarily to video poker games, and more particularly to video poker games that are programmed to play on an electronic video poker machine. The deck of cards used in the game is provided with one or more additional "bonus" cards that result in the player being awarded one or more bonus hands whenever a bonus hand card appears in the player's hand. Other triggering events may be used to effect the awarding of one or more additional hands to the player.

BACKGROUND OF THE INVENTION

Video poker that is played on an electronic video poker gaming machine is designed to replicate the play of a hand of poker. Typically, the player is not playing against any other player's hands or against a dealer's hand; the player is simply attempting to achieve the highest ranking poker hand possible from the cards displayed to the player. The higher the ranking of the poker hand achieved by the player, the greater the player's winnings based on the number of coins, tokens or credits wagered by the player. Typically, a payout schedule is posted on the gaming machine to advise the player of the payoffs available for certain winning card combinations.

The forerunner of all electronic video poker gaming machines is the video Draw Poker machine that deals cards from a standard 52 card poker deck and displays a single five card hand to the player. The player then selects which of the five cards he wishes to hold (or discard depending on the format of the gaming machine). The draw poker machine then displays replacement cards for the cards the player has discarded. The player wins or loses based on conventional poker hand rankings for the resulting five card hand.

In video Draw Poker, the conventional poker hand rankings that are winning combinations are a Royal Flush, a Straight Flush, a Four of a Kind, a Full House, a Flush, a Straight, a Three of a Kind, a Two Pair and a Pair of Jacks or Better. A payout table is established based on the number of coins wagered by the player and the type of poker hand achieved.

The classic draw poker machine has been modified to use Jokers as wild cards or to use Deuces (or even other cards) as wild cards. "Jokers Wild" and "Deuces Wild" draw poker still display to the player a single five card hand and allow the player to discard unwanted cards and receive replacement cards. The payout table is modified to recognize the differing odds for achieving various poker hands when wild cards are involved. Furthermore, different poker hand rankings are used in the pay table to recognize different winning combinations that can be achieved using wild cards.

There are many poker formats used in video draw poker. These poker game formats include Jacks (or even Tens) or Better Draw Poker, Bonus Poker, Double Bonus Poker, Double Double Bonus Poker, Super Double Bonus Poker, Triple Bonus Poker, Deuces Wild Poker, Jokers Wild Poker, Deuces and Jokers Wild Poker, etc. Many electronic video poker gaming machines are provided with a menu so that the player can indicate his choice of the poker game format that the player wishes to play and the player then makes his wager based on upon that choice of poker game format. Each poker format has its own pay table associated therewith.

U.S. Pat. No. 5,823,873 (Moody) (the disclosure of which is incorporated herein by this reference) describes an electronic video gaming machine and method in which the player may play multiple hands at the same time. The player makes a wager for each separate hand to be played by the player. One hand of five cards is dealt all face up. The player selects none, one or more of the face up cards from the first hand as cards to be held. The cards that are held are reused from the first hand into all of the other hands. Replacement cards for the non-selected cards are dealt into the first hand and additional cards are then dealt to the first hand, if needed, so that the first hand has five cards. Additional cards are also dealt to all of the other hands so that each hand is a five card hand. The poker hand ranking of each five card hand is determined row by row. The player is then paid for any winning poker hands based on a pay table and the amount of the player's wager.

It is an object of the present invention to provide a new form of an electronic video poker game that provides the player with an additional video poker hand whenever a bonus hand card is dealt or other triggering event occurs during the play of the game.

It is a feature of the present invention to provide one or more bonus hand cards to the conventional deck of playing cards used for the video poker game. If the player receives a bonus hand card during the initial deal of the video poker hand or as one of the replacement cards during the draw step of the video poker game, the player receives another video poker hand without having to make an additional wager.

It is another feature of the present invention to provide a triggering event that occurs during the play of the video poker game that results in the player receiving another video poker hand without having to make an additional wager.

It is an advantage of the present invention that the player is provided with an additional hand of video poker to play without having to make another wager. This increases the player's opportunity to achieve a winning outcome without increasing the monetary risk to the player.

Other objects, features and advantages of the present invention will become apparent from a consideration of the following detailed description.

SUMMARY OF THE INVENTION

The game of the present invention plays in a manner similar to conventional video poker with the exception that one or more additional cards are added to the deck of playing cards. These additional cards are designated as "bonus hand" cards. The bonus hand cards have no playing value in the video poker game; rather, when a bonus hand card appears in the player's initially dealt hand of cards, the player receives a second bonus hand of the initially dealt hand of cards. Alternatively, if the bonus hand card appears as one of the replacement cards during the draw step of video poker, the player is provided with another poker hand.

In an alternative embodiment of the present invention, another type of triggering event is provided which awards the player another hand of video poker for no additional charge if the triggering event occurs during the player of the video poker hand.

DETAILED DESCRIPTION OF THE PREFERRED EMBODIMENTS

Figure 1:
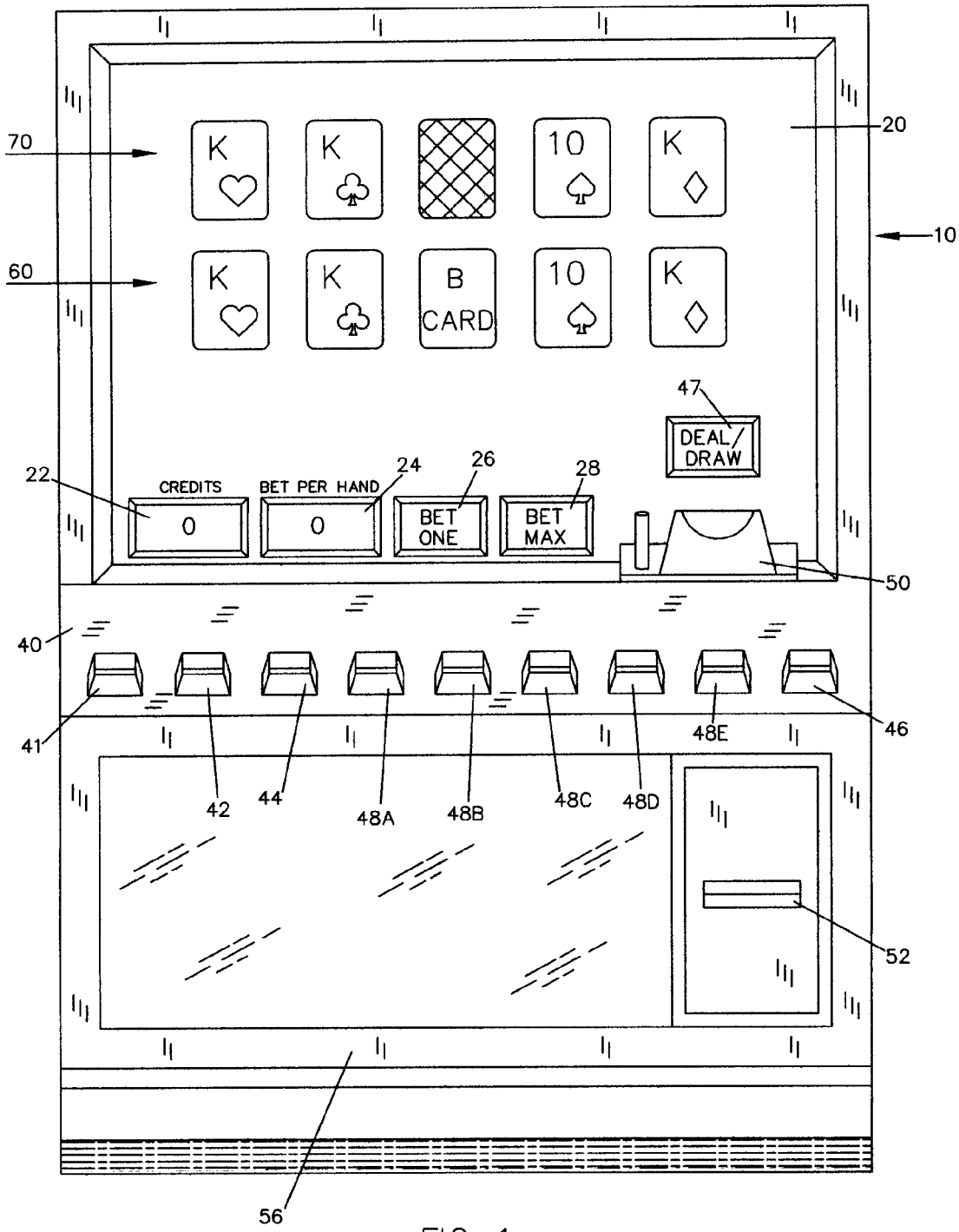
FIG. 1 shows a representative electronic video gaming machine of the present invention including a typical screen display used in the method of play of version #1 of the present invention after the initial deal of the cards.

The method of the present invention can be applied to any poker format used for video poker. FIG. 1 shows generally at 10 a typical electronic video gaming machine that is configured to provide to the player the method of the present invention. The electronic video gaming machine 10 includes a conventional coin head 50 into which the player can insert coins or gaming tokens and a slot 52 which leads to a conventional bill acceptor mounted on the interior of the gaming machine and into which the player can insert paper currency. The use of coins, tokens or paper currency is the mechanism by which the player wagers on the poker hands the player wishes to play. As is also conventional in electronic video gaming machines, a credit meter display 22 is provided to show the amount of credits that the player has accrued on the gaming machine 10—either by inserting coins, tokens or paper currency or from winning plays achieved by the player. Whenever the player makes a wager, the amount of the wager is decremented from the credit meter display 22. Whenever the player achieves a winning play during the play of the game, the amount of the winning play is incremented on the credit meter display 22.

A conventional payout hopper is also located on the interior of the gaming machine and is used to dispense coins or tokens to the player into a payout tray 56 when the player wishes to collect any winning amounts the player has accrued. Other suitable and conventional payout mechanisms can be used, such as a ticket printer or other cashless payout devices.

The gaming machine 10 also includes a video screen display 20 of any suitable type upon which representations of playing cards are displayed. In a preferred embodiment of the present invention, one or more hands can be displayed on the video screen display 20 at the same time. As shown in FIG. 1, a first hand: HAND ONE 60 is shown. Each hand would preferably have five card locations preferably from left to right in a horizontal row, although other manners of displaying multiple hands can be used. The video screen display 20 also contains a location at which the amount wagered on each hand is shown, for example, "Bet Per Hand" 24.

A button panel 40 is also provided on the gaming machine 10 and the buttons mounted on the button panel 40 are used by the player to control the operation of the gaming machine 10. Any suitable configuration of the buttons on the button panel can be used and, alternatively, conventional touch screen technology can be used for any or all of the buttons mounted on the button panel.

A typical button arrangement is shown on the button panel 30 in FIG. 1. A "BET ONE" button 42 is provided to allow the player to wager one credit at a time. A "BET MAX" button 44 is provided to allow the player to wager the maximum amount of credits permitted by the configuration of the gaming machine 10. Any number of credits can be set as the maximum amount that it is possible to wager on each hand and, typically, five credits will be the maximum number of credits for any particular hand. Alternatively, a BET ONE location 26 and a BET MAX location 28 can be provided on the video screen 20 to allow the player to wager by using conventional touch screen technology.

A conventional "DEAL/DRAW" button 46 is also provided on the button panel 40 which is used by the player to activate the initial deal of the cards at the deal stage of the method of play or the dealing of replacement cards at the draw stage of the method of play as is appropriate. Similarly, a DEAL/DRAW location 47 can be provided on the video screen 20 to allow the player to effect either the deal step or the draw step by using conventional touch screen technology.

The button panel 40 is also provided with five "CARD" buttons 48A, 48B, 48C, 48D and 48E associated with each horizontal card location on the video screen display: card button 48A is associated with the left most card location, card button 48B is associated with the second from the left card location, card button 48C is associated with the middle card location, card button 48D is associated with the second from the right card location and card button 48E is associated with the right most card location. Each card button is preferably aligned below the card locations so that the player can easily associate the appropriate card button with the appropriate card location.

The method of play of the various versions of the present invention will now be described. After the player has inserted an appropriate amount of coins, tokens or paper currency to add a sufficient amount of credits on the credit display meter 22, the player makes his initial wager. The player may press the BET ONE button 42 one or more times to bet in single increments or the player may merely press the "BET MAX" button 44 and the maximum number of credits are applied, for example, five credits would be wagered. The player can also use the touch screen locations to make his wager as described above.

Version #1

This version of the present invention is played using a fifty-three card deck of playing cards consisting of the standard fifty-two card deck supplemented with one bonus hand card. The bonus hand card is active only on the initial deal.

The player makes a wager to participate in the method of play. A first five card hand, HAND ONE 60 shown in FIG. 1, is dealt to the player with all cards dealt face up. If the player does not receive a bonus hand card as one of the cards the player receives on the initial deal of the first hand, then the player plays only that first hand. This first hand is played out as is conventional in video draw poker—the player holds those cards he wishes to hold and the unheld cards are discarded and replaced with replacement cards which are displayed face up. This results in a final five card hand. The poker hand ranking of the final five card is determined and the player receives an award if the player has achieved a winning poker hand ranking on the final five card hand.

If the player receives a bonus hand card as one of the cards the player receives on the initial deal of the first hand, the player also receives a second bonus hand, HAND TWO 70, with the same four cards as were dealt in the first hand (other than the bonus hand card). This second hand also includes a fifth card back, which may be designated as the B card as shown in FIG. 1. The B card is displayed face down and the B card also has no value in the second hand. In effect, the B card is simply a card location place holder until the draw step occurs. There is no additional wager required for the player to receive this second hand.

The player then decides which cards he wishes to hold from the first hand. The player cannot hold the bonus hand card, since this bonus hand card has no play value, there is no reason for the player to hold the bonus hand card hand. The cards that are held in the first hand are also held in the second bonus hand. Alternatively, the player may hold the same or different cards in both the first hand and the second hand.

After the player has made the selection of which cards the player wishes to hold in both the first hand and the second hand, if any, replacement cards are displayed for the discarded cards in the first hand including the discarded bonus hand card resulting in a final first hand. Also, replacement cards are displayed for the discarded cards in the second hand including the face down B card resulting in a final second hand.

The replacement cards for each of the first hand and the second bonus hand are dealt from two separate forty-eight card decks which comprise the original fifty-three card deck minus the five originally dealt cards.

The poker hand rankings of the final first hand and the final second hand are determined. The player is paid based on the poker hand rankings for each of the first final hand and the second final hand that has for winning poker hand ranking hand based on a pay table. The amount wagered on the bonus hand is deemed to be the same as the amount wagered on the first hand for purposes of determining any winning payouts from the pay table.

In this version if the player receives the bonus hand card as one of the draw cards the card has no value and the player's hand is evaluated based on the remaining four cards. (Four card straights and four card flushes would not be winning hands and would have no value.)

For example, as shown in FIG. 1, the player is dealt the King of Hearts, the King of Clubs, the King of Diamonds and the Ten of Spades and a bonus hand card in HAND ONE 60. Because HAND ONE 60 included a bonus hand card, the player receives a second hand, HAND TWO 70, of the same four cards and a face down B card in lieu of the bonus hand card. The player may hold any of the cards in HAND ONE 60 except the bonus hand card and the same cards will be held in HAND TWO 70 except the face down B card.

Figure 2:
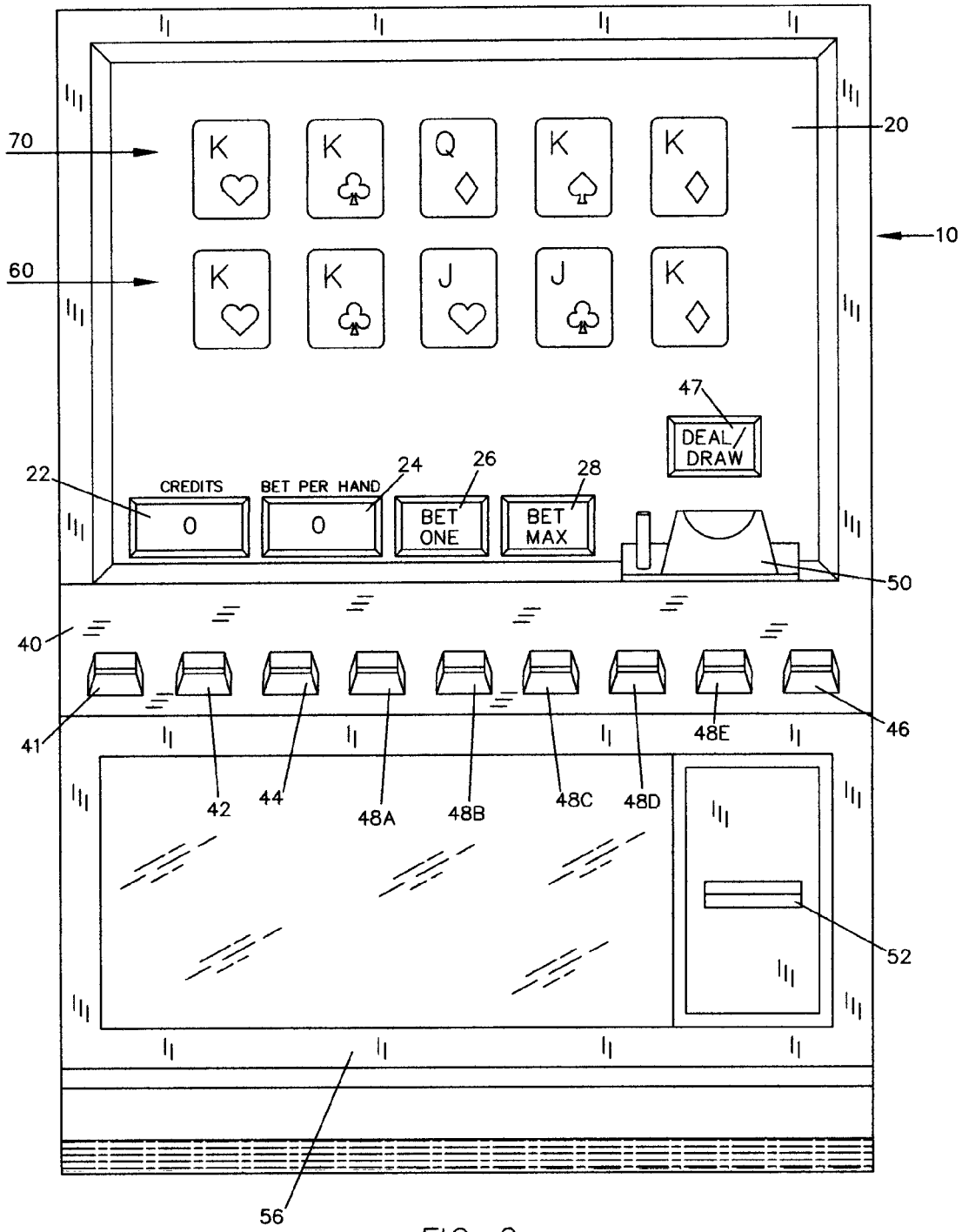
FIG. 2 shows a representative electronic video gaming machine of the present invention including a typical screen display used in the method of play of version #1 of the present invention after the draw step and the dealing of replacement cards.

As shown in FIG. 2, the player holds the three kings in both HAND ONE 60 and HAND TWO 70. The player then activates the DRAW button 46 (or the DRAW touch screen location) and is dealt replacement cards into each hand. As shown in the example in FIG. 2, the player receives a Jack of Hearts and a Jack of Clubs in HAND ONE 60 for a Full House and the player receives in HAND TWO 70 a Queen of Diamonds and a King of Spades for Four-of-a-Kind. The player would be paid for a Full House in HAND ONE 60 and for Four Kings in HAND TWO 70 based on the same wager amount for both hands according to the pay table being used.

Any suitable pay table may be used and would be associated with the poker format being used by the player. For example, the classic poker hand format is Jacks or Better Draw Poker. A suitable pay table for Jacks or Better Draw Poker is shown in Table 1:

TABLE 1

| JACKS OR BETTER DRAW POKER | | | | | |
|---|---|---|---|---|---|
| POKER HAND | NUMBER OF COINS WAGERED | | | | |
| RANKING | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND | 25 | 50 | 75 | 100 | 125 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

Version #2

This version #2 is played similarly to version #1 except that the bonus hand card is active on the draw step as well as on the initial deal step. If the player receives a bonus hand card as one of the draw cards, he receives a second hand of the cards that were held from the first hand as well as additional draw cards to make a five card hand. The player would then have a four card original hand and a second five card bonus hand that would be paid according to the pay table being used.

Figure 3:
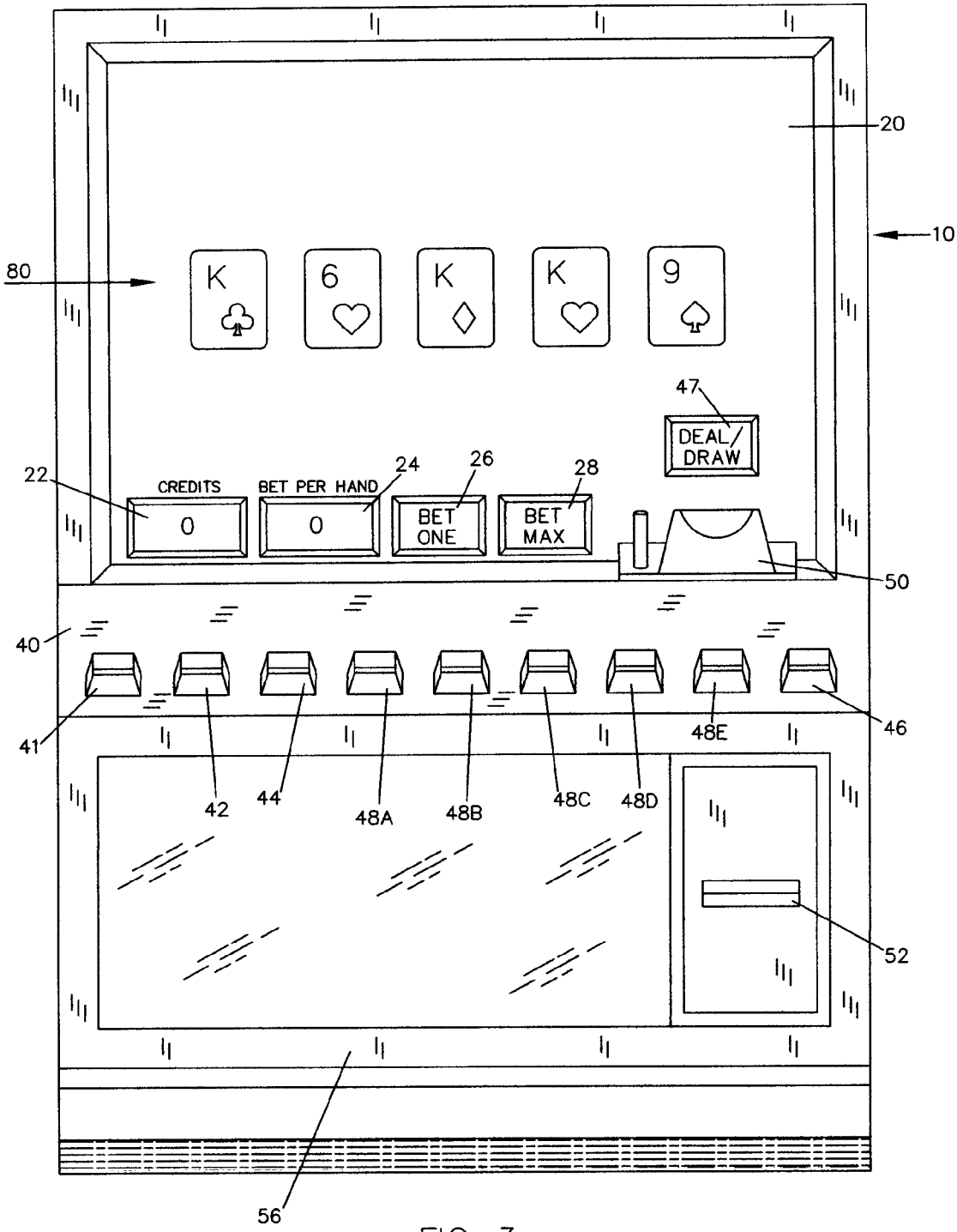
FIG. 3 shows a representative electronic video gaming machine of the present invention including a typical screen display used in the method of play of version #2 of the present invention after the initial deal of the cards.

For example, as shown in FIG. 3, the player is dealt as his initial HAND ONE 80 a King of Clubs, a Six of Hearts, a King of Diamonds, a King of Hearts and a Nine of Spades. None of these cards are a bonus hand card, so the player simply selects which of these cards the player wishes to hold as in conventional video draw poker. In this example, the player would hold the three kings in HAND ONE 80 and activates the DRAW button to effect the draw step of the game.

Figure 4:
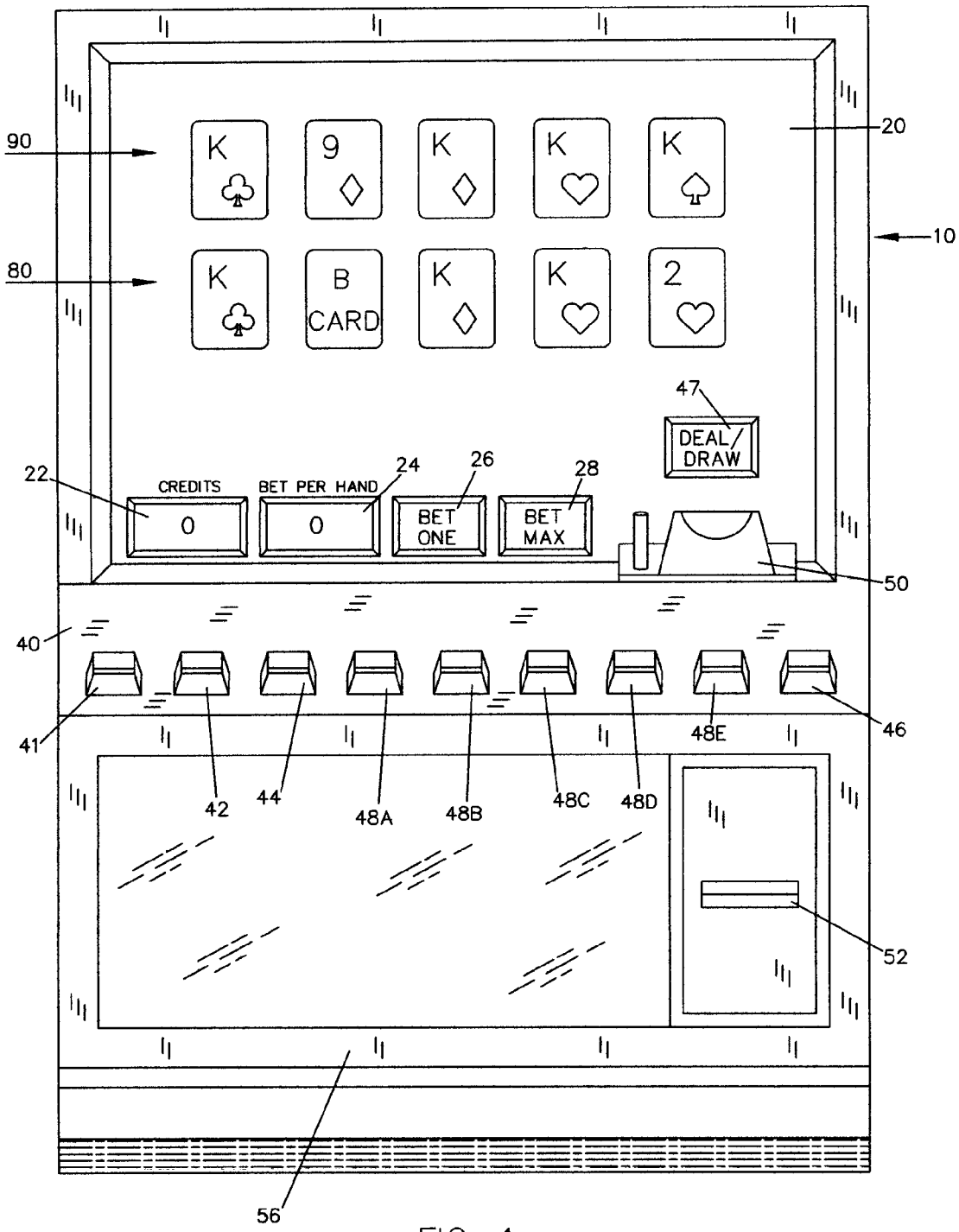
FIG. 4 shows a representative electronic video gaming machine of the present invention including a typical screen display used in the method of play of version #2 of the present invention after the draw step and the dealing of replacement cards.

FIG. 4 shows the result of the draw step. In this example, the player received in HAND ONE 80 a bonus hand card and a Two of Hearts. Because in the draw step the player received a bonus hand card, the player is awarded a bonus hand, HAND TWO 90, comprising the three Kings which were the card that were held from HAND ONE 80. Two more cards are dealt into HAND TWO 90 to complete this hand as a five card hand. As shown in the example of FIG. 4, the player was dealt a Nine of Diamonds and a King of Spades in HAND TWO 90. The result of this example is that the player achieved a poker hand ranking of Three Kings in HAND ONE 80 and a poker hand ranking of Four Kings in the bonus HAND TWO 90. The player would be paid based on the same wager amount for both hands according to the pay table being used.

Version #3

This version would be played with two bonus hand cards, instead of one bonus hand card as in the earlier versions. The use of two bonus hand cards allows the player to have as many as two bonus hands for a total of three hands since the player receives a bonus hand each time one of the bonus hand cards appears. Depending on the method of play being used with the two bonus hand cards, the bonus hand cards would be active only on the deal as in version #1 or active on both the deal and draw as in version #2.

For example, if the player received three Kings and two bonus hand cards in HAND ONE on the initial deal, the player would receive two additional bonus hands of three Kings and two face down B cards. When the player holds the three Kings and activates the DRAW button, the player receives two additional draw cards to replace the bonus hand cards in HAND ONE. The player also receives two additional draw cards to replace the face down B cards in each of the two bonus hands. Winning poker hand rankings are paid in each hand based on the same wager amount for each hand according to the pay table being used.

Version #4

This version plays the same as versions #1, #2 and #3 except that the bonus hand cards are not actually part of the player's hand. For example if the player receives a bonus hand card as part of the initial deal of HAND ONE, the bonus hand card would be removed from HAND ONE and the player would receive an additional card to make a five card starting HAND ONE. The player would also receive a bonus HAND TWO of these same five cards. Thus, in this version #4, the bonus hand cards do not affect the play of the game or the evaluation of the poker hand ranking of the resulting hands.

If the method of any of the versions of the present invention is used with one of the Joker poker formats, then the standard deck of playing cards would include one or more Jokers as would apparent to one skilled in the art. The bonus hand card or bonus hand cards would then be used in conjunction with this deck of playing cards that include the Joker or Jokers and an appropriate pay table suitable for one of the Joker poker formats would be used.

The method of the present invention has been described using one or more bonus hand cards as the triggering event for the player receiving one or more additional hands without having to make an additional wager. However, other triggering events can be used by which the player can receive one or more additional hands.

For example, the video poker gaming machine can be configured to simply award the player on a random basis one or more additional hands of the same cards as the player received on the initial deal. The player would then select which cards to hold, with the same cards being held in each hand. Alternatively, the player may select the same or different cards from each hand as cards to be held. Replacement cards would be dealt for the discarded cards and the poker hand ranking of each final hand would be determined. Winning poker hand rankings are paid in each hand based on the same wager amount for each hand according to the pay table being used.

Additionally, the bonus hand card could simply be one of the cards of the standard deck of fifty-two cards which has been designated as the bonus hand card. For example, the Ace of Spades can be designated as the bonus hand card, although any card can be designated as desired. If the player receives the Ace of Spades as part of the display of the cards of the initial first hand, then the player would receive a second hand having the same five cards including the Ace of Spades as the initial first hand. The second hand would be played out in any of the manners described above. Similarly, if the designated card appeared in the player's hand during the draw step of the poker game, a second hand would be displayed to the player and played out as described above in connection with the bonus hand card appearing during the draw step.

Also, two designated cards from the standard fifty-two card deck could be used in the same manners as described above in connection with the use of two bonus hand cards.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a card game comprising:

a) a player making a wager;

b) providing a deck of playing cards comprising at least a standard fifty-two card deck;

c) from the deck of playing cards, displaying an initial first hand of at least five cards all face up;

d) on a random basis, displaying an initial second hand having the same cards face up as the initial first hand;

e) selecting none, one or more of the face up cards from the initial first hand as cards to be held, discarding the unselected cards and displaying replacement cards for the discarded cards resulting in a final first hand;

f) if the initial second hand has been displayed, selecting none, one or more of the face up cards from the second hand as cards to be held, discarding the unselected cards and displaying face up replacement cards for the discarded cards resulting in a final second hand;

g) determining the poker hand ranking of the final first hand and the poker hand ranking of the final second hand;

h) paying the player a pre-established amount based on the amount of the wager if the final first hand comprises a winning poker hand ranking; and i) paying the player a pre-established amount based on the amount of the wager if the final second hand comprises a winning poker hand ranking.

2. The method of claim 1 in which different cards are held in the initial first hand and the initial second hand.

3. The method of claim 1 in which the same cards are held in both the initial first hand and the initial second hand.

* * * * *